US005095952A

United States Patent [19]

Cheng

[11] Patent Number: 5,095,952

[45] Date of Patent: Mar. 17, 1992

[54] ELECTROMAGNETIC HEALD ROD RETENTION SYSTEM FOR A JACQUARD SYSTEM

[76] Inventor: Yu Hsiu Hsia Cheng, 2 Fl., No. 25, Sec. 2, Syh Chuan Rd., Pan Chiao City, Taipei, Taiwan

[21] Appl. No.: 637,055

[22] Filed: Jan. 3, 1991

[51] Int. Cl.[5] ..... D03C 3/20

[52] U.S. Cl. ..... 139/65; 139/455

[58] Field of Search ..... 139/455, 65

[56] References Cited

U.S. PATENT DOCUMENTS 4,515,186 5/1985 Durville et al. ..... 139/65 X
4,690,178 9/1987 Bassi et al. ..... 139/65
4,936,357 6/1990 Keim et al. ..... 139/65

*Primary Examiner*—Andrew M. Falik
*Attorney, Agent, or Firm*—Fitch, Even, Tabin & Flannery

[57] ABSTRACT

A heald retention system has a retention bar which provides a recess and lateral openings adjacent to an upper portion of the recess which contains a retention mechanism to extend from the lateral openings and a solenoid for actuating the retention mechanism. A spacing member is spacedly positioned beside the retention bar to form a gap with the retention bar, and a heald rod reciprocates along a rectilinear path in the gap and provides a receiving hole at an upper portion thereof to engage with the retention mechanism at an end of an upper movement thereof.

3 Claims, 3 Drawing Sheets

ELECTROMAGNETIC HEALD ROD RETENTION SYSTEM FOR A JACQUARD SYSTEM

BACKGROUND OF THE INVENTION

This invention relates to a heald rod retention system.

Typically, referring to FIG. 4, a heald rod retention bar 80 of an electronic jacquard system provides one or more electromagnets 81 and a latch 82 thereon. Thus while a heald rod or hook 90 reciprocates along a lateral surface of the retention bar, the electromagnets may be energized and deflect the heald rod upward, such that the retention bar may perform retention by engaging the tilted heald rod with a latch thereof.

In such a case, the heald rod has to be made with resilient and magnetically conductive material, and after continued use, the heald rod may become worn and malfunction because of elastic fatigue, and needs to be replaced.

Further, the deflection of the heald rod is completed by magnetic attraction of the electromagnet deposited in the retention bar. In a jacquard system, there are hundreds of heald rods, thus the requirements of electricity are very substantial to energize the electromagnets to deflect all of the heald rods.

It is the purpose of this present invention, therefore, to mitigate and/or obviate the above-mentioned drawback in the manner set forth in the detailed description of the preferred embodiment.

SUMMARY OF THE INVENTION

The present invention provides a heald rod controlling system including a retention bar providing a retention means and a solenoid deposited therein, and a heald rod which reciprocates on a rectilinear path along a lateral surface of the retention bar. When the heald rod moves to an upper end of the path, the retention means will keep the rod in position by means of engaging a plate thereof into a receiving hole of the heald rod.

DETAILED DESCRIPTION OF THE PREFERRED EMBODIMENT

Figure 1:
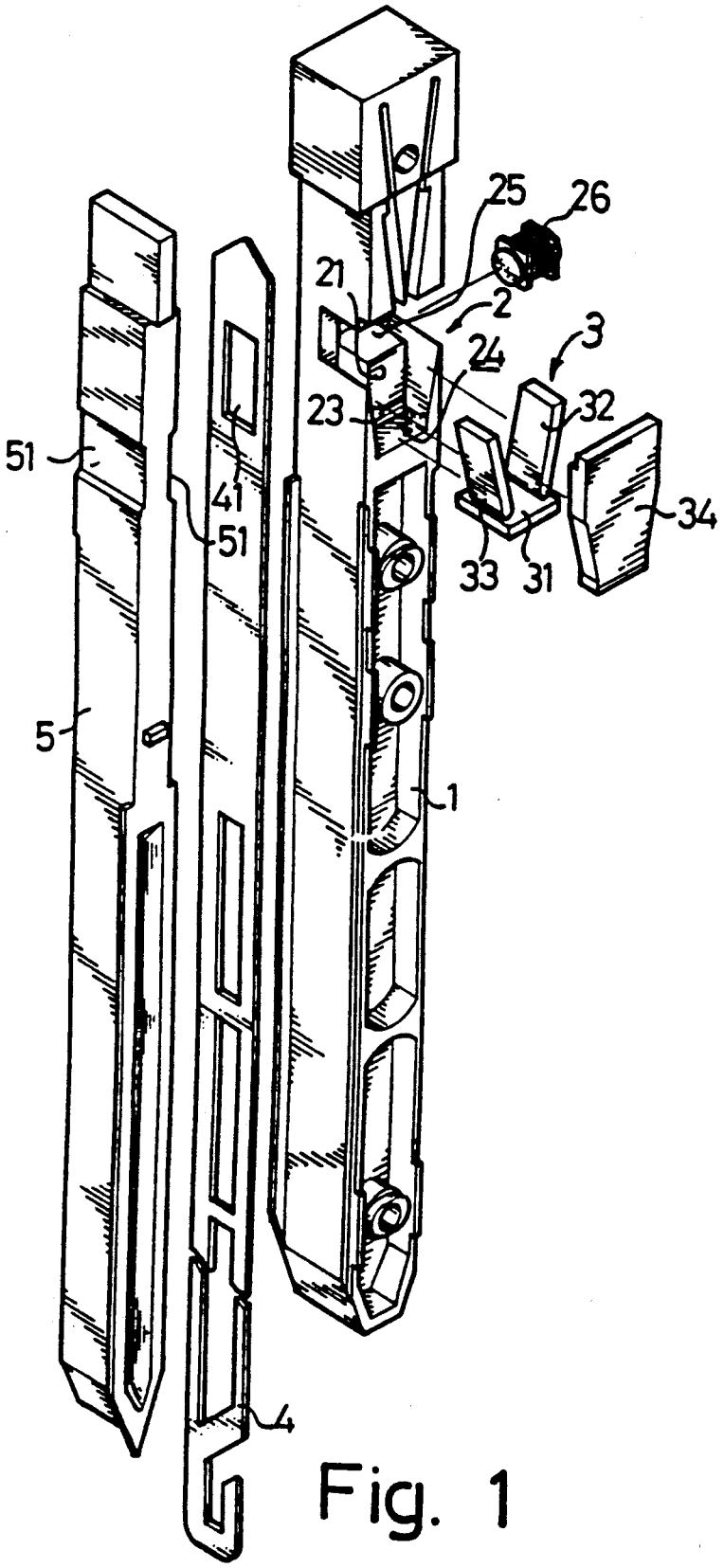
FIG. 1 is an exploded view of a heald rod retention device in accordance with the present invention.

Referring to FIG. 1, a retention bar in accordance with the present invention is indicated at 1. A depression is provided in an upper portion of the retention bar 1, and has two lateral openings designated by 2 at an upper portion thereof. A suspended fixing block 21 is disposed inside the depression and connects to a lower portion of a back wall thereof, forming a receiving channel 25 between a top surface of the fixing block 21 and the depression, and forming a receiving slot 24 between a bottom of the fixing block 21 and the depression. On both lateral inner walls of the depression, there is provided an outward sloped surface 23, such that from a front view, the inner wall of a lower portion of the depression will be U-shaped with an enlarged opening.

A retention means in accordance with the present invention is indicated at 3 and comprises a magnetic supporting plate 31 and two magnetically conductive light-weight retention plates 32 and 33. The magnetic supporting plate 31 is inserted into the receiving slot 24 defined by a bottom of the fixing block 21 and a bottom surface of the depression.

A solenoid 26 is deposited in the receiving channel 25 defined by a top surface of the fixing block 21 and a top surface of the depression for activating the retention plates 32 and 33.

A spacing member 5 is positioned beside the retention bar 1 and forms a gap with the retention bar 1, allowing reciprocating movement of a heald rod 4. At an upper portion, the spacing member 5 provides a recess 51 on each lateral side thereof, which correspond to the openings 2 of the retention bar 1. Further, there is provided a cover 34 to protect the recess against dust.

Figure 2:
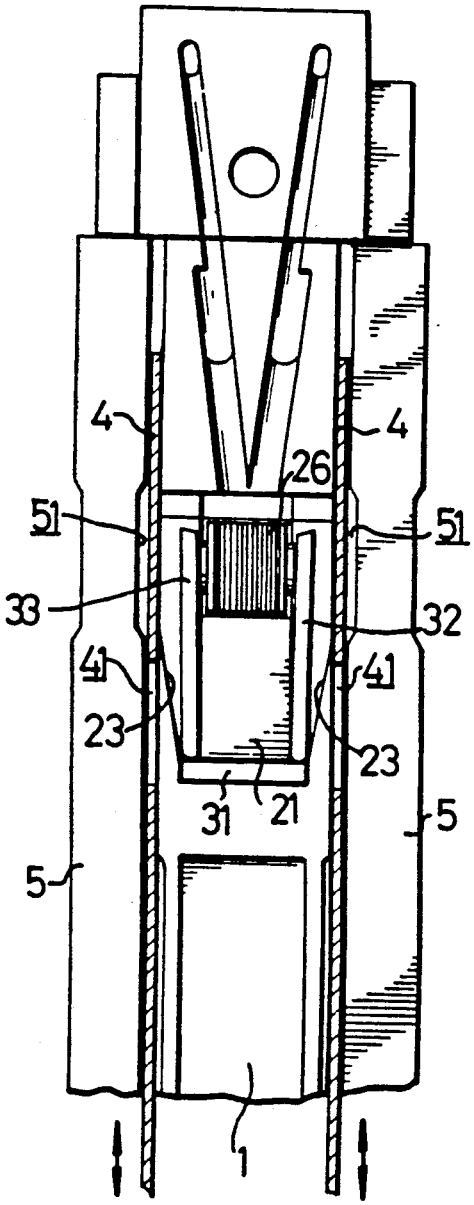
FIG. 2 is a front view of a heald rod retention device, wherein the retention means is in a retracting position.
Figure 3:
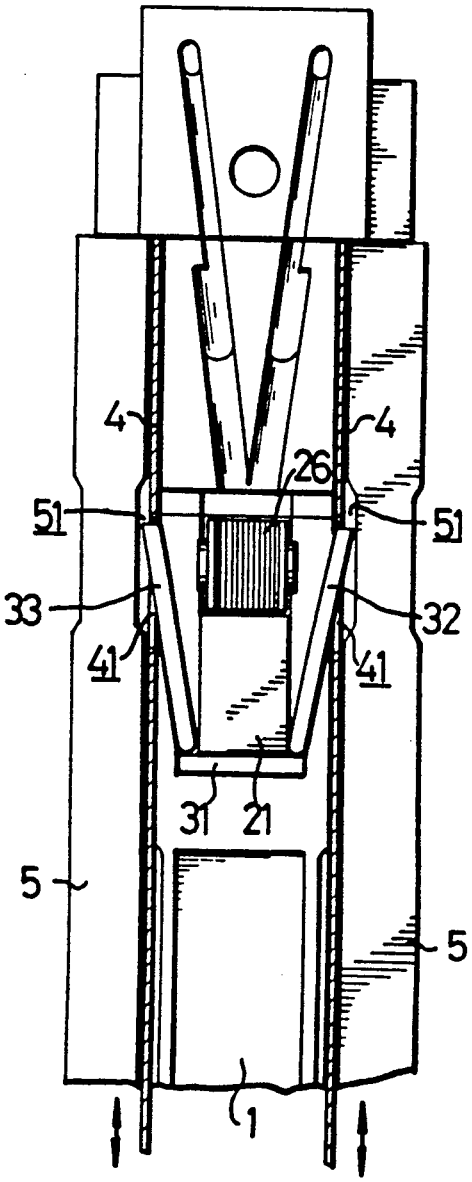
FIG. 3 is similar to FIG. 2, wherein the retention means is in an activated position.
Figure 4:
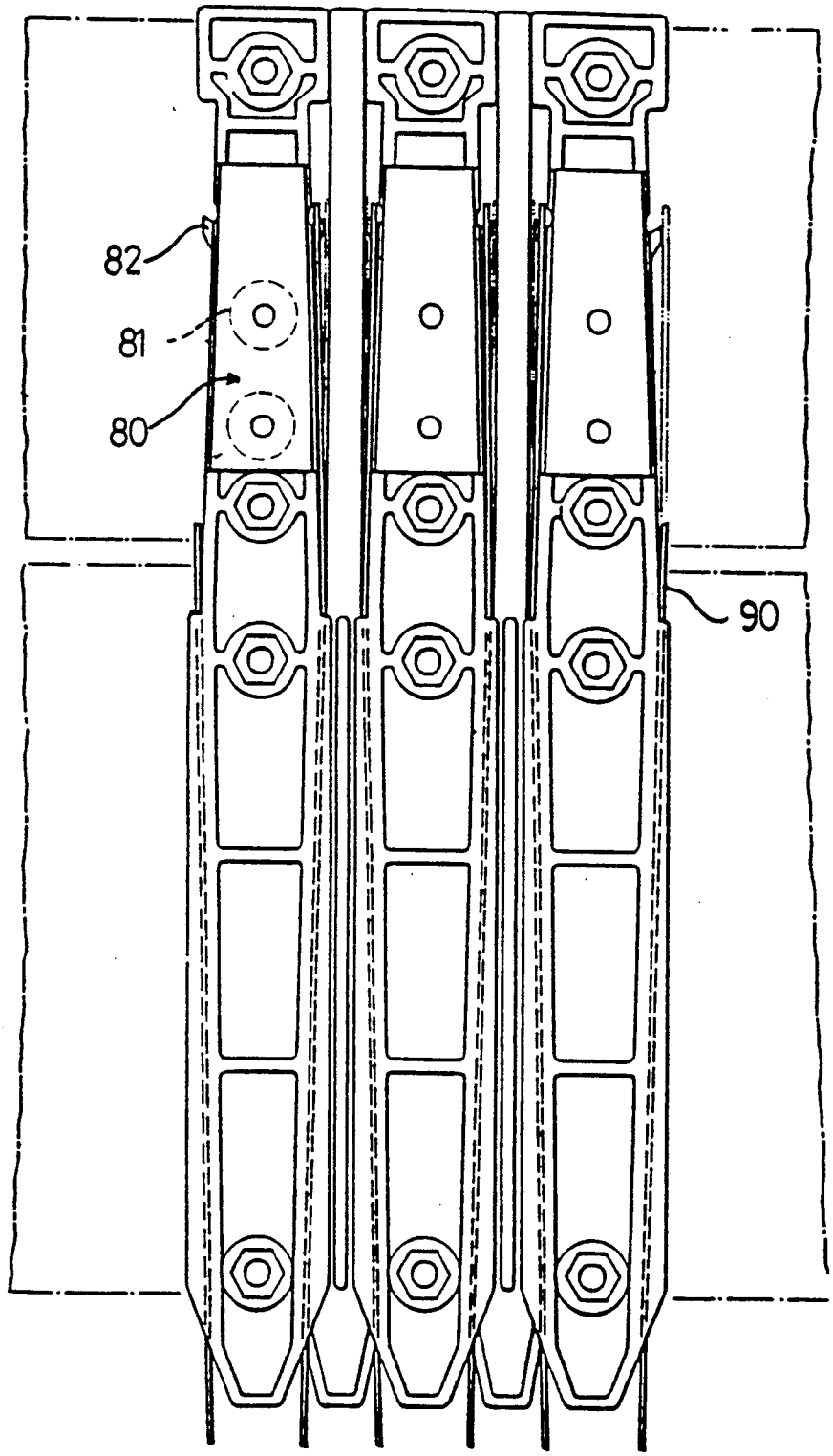
Fig. 4 PRIOR ART
FIG. 4 shows a diagrammatic representation of a heald rod retention device in parts according to prior art.

Referring to FIGS. 2 and 3, where a combination of all elements above-mentioned is shown in operation, heald rods 4 reciprocate along a rectilinear path defined by the retention bar 1 and spacing member 5 in a conventional manner. Since the retention plates 32 and 33 contact the magnetic supporting plate 32, the ends of the retention plates 32 and 33 will be magnetized to be different magnetic poles from each other. Magnetic attraction causes the retention plates 32 and 33 to attract each other and connect to opposite ends of the solenoid 26, respectively, and thus to be in a retracted position (FIG. 2).

When the heald rod 4 travels to a top end of the rectilinear path, then the solenoid 26 is electrically energized to produce a reversed magnetic field against the magnetic supporting plate 31, which creates magnetic repulsion and causes the retention plates 32 and 33 to repel to a position against the lateral sloped surfaces 23 of the recess of the retention bar 1, respectively (FIG. 3). This will cause the top end of the retention plate to protrude through the lateral opening 2 and penetrate a receiving hole 41 of the heald rod 4 and continue into the recess 51 on the spacing member 5. Thereby, the heald rod 4 is held in an "up" position. The heald rod 4 is retained until the current energizing the solenoid is interrupted, at which time the retention plates 32 and 33 attract each other through the solenoid 26 and retract from their holding positions to release the heald rod 4.

Since it is not necessary to deflect the heald rod 4, the material of the heald rod is not restricted to be a magnetically conductive material. The required magnetism of the solenoid for repelling the retention plates is weaker than that of the conventional device. Therefore, there is the advantage in saving the number of electromagnets used and electricity consumed.

It is to be understood, however, that even though numerous characteristics and advantages of the present invention have been set forth in the foregoing description, together with details of the structure and function of the invention, the disclosure is illustrative only, and changes may be made in detail within the principles of the invention to the full extent indicated by the broad general meaning of the terms in which the appended claims are expressed.

I claim:

1. A heald rod retention system comprising:

a retention bar including an upper portion defining two lateral walls, a recess between said two lateral walls, and two openings through said two lateral walls;

a retention means deposited in said recess in said retention bar having two retention plates electromagnetically actuatable to extend through the openings in said lateral walls;

a spacing bar being spacedly mounted beside said retention bar, thereby defining a gap between said retention bar and said spacing bar; and a heald rod for reciprocation along a rectilinear path having an upper end and a lower end within said gap, said heald rod including an upper portion defining a receiving hole to engage with said retention plate of said retention means when said heald rod is at the upper end of said rectilinear path.

2. A heald retention system as claimed in claim 1, wherein said recess of said retention bar contains a protuberant fixing block between said lateral walls and wherein each of said lateral walls has an inner surface declining from the respective opening therein.

3. A heald retention system as claimed in claim 2, wherein said retention means has a magnetic plate with two lateral ends and two pivotally rotatable magnetically conductive retention plates each residing on one of said lateral ends.

* * * * *

UNITED STATES PATENT AND TRADEMARK OFFICE

CERTIFICATE OF CORRECTION

PATENT NO. : 5,095,952

DATED : March 17, 1992

INVENTOR(S) : Yu Hsiu Hsia CHENG

It is certified that error appears in the above-identified patent and that said Letters Patent is hereby corrected as shown below:

Column 2, line 26, change "32" to --31--.

IN THE CLAIMS:

Column 3, line 3, change "in", second occurrence, to --of--.

Signed and Sealed this

Eighth Day of June, 1993

*Attest:*

Michael K. Kirk

MICHAEL K. KIRK

*Attesting Officer*

*Acting Commissioner of Patents and Trademarks*